United States Patent [19]

Iseda et al.

[11] Patent Number: 5,069,870

[45] Date of Patent: Dec. 3, 1991

[54] HIGH-STRENGTH HIGH-CR STEEL WITH EXCELLENT TOUGHNESS AND OXIDATION RESISTANCE

[75] Inventors: Atsuro Iseda, Kobe; Yoshiatsu Sawaragi, Nishinomiya, both of Japan

[73] Assignee: Sumitomo Metal Industries, Ltd., Osaka, Japan

[21] Appl. No.: 489,012

[22] Filed: Mar. 6, 1990

[30] Foreign Application Priority Data

Mar. 6, 1989 [JP] Japan ..... 1-53232

[51] Int. Cl.[5] ..... C21D 6/00

[52] U.S. Cl. ..... 420/70; 148/325; 420/67; 420/68; 420/69

[58] Field of Search ..... 420/67, 68, 69, 70; 148/325

[56] References Cited

U.S. PATENT DOCUMENTS

| | | | |
|---|---|---|---|
| 4,294,613 | 10/1981 | Giflo | 75/124 |
| 4,477,280 | 10/1984 | Shiga et al. | 420/69 |
| 4,564,392 | 1/1986 | Ohhashi et al. | 420/69 |
| 4,652,428 | 3/1987 | Maruhashi et al. | 420/67 |
| 4,689,095 | 8/1987 | Coulon et al. | 420/69 |
| 4,799,972 | 1/1989 | Masuyama et al. | 148/325 |
| 4,844,755 | 7/1989 | Hashimoto et al. | 420/69 |
| 4,846,904 | 7/1989 | Arai et al. | 148/325 |
| 4,857,120 | 8/1989 | Watanabe et al. | 148/325 |
| 4,917,738 | 4/1990 | Takano et al. | 420/69 |

FOREIGN PATENT DOCUMENTS

| | | | |
|---|---|---|---|
| 55-110758 | 8/1980 | Japan . | |
| 0158256 | 12/1980 | Japan | 420/70 |
| 57-36341 | 8/1982 | Japan . | |
| 58-81849 | 10/1983 | Japan . | |
| 59-211553 | 11/1984 | Japan . | |
| 61-10753 | 5/1986 | Japan . | |
| 61-110753 | 5/1986 | Japan . | |
| 62-8502 | 2/1987 | Japan . | |
| 62-12304 | 3/1987 | Japan . | |
| 62-89842 | 4/1987 | Japan . | |
| 62-297436 | 12/1987 | Japan . | |
| 63-65059 | 3/1988 | Japan . | |
| 63-76854 | 4/1988 | Japan . | |
| 55-1406 | 3/1977 | U.S.S.R. . | |

*Primary Examiner*—Upendra Roy

*Attorney, Agent, or Firm*—Burns, Doane, Swecker & Mathis

[57] ABSTRACT

A high-strength high-Cr steel with excellent high-temperature strength and toughness as well as improved resistance to oxidation and high-temperature corrosion is disclosed, which consists essentially of, in weight %:

C : 0.04–0.2%, Si: not greater than 0.7%, Mn: 0.1–1.5%, Ni: not greater than 1%, Cr: 8–14%, Mo: 0.01–1.2%, W: 0.8–3.5%, V : 0.1–0.3%, Nb: 0.01–0.2%, Al: not greater than 0.05%, Cu: 0.4–3%, Mg: 0.0005–0.5%, N: 0.001–0.1%, B : 0–0.02%, at least one of La, Ce, Y, Ca, Ti, Zr, and Ta each in an amount of 0–0.2%, and Fe and incidental impurities: balance.

25 Claims, 5 Drawing Sheets

HIGH-STRENGTH HIGH-CR STEEL WITH EXCELLENT TOUGHNESS AND OXIDATION RESISTANCE

BACKGROUND OF THE INVENTION

This invention relates to a high-strength high-Cr steel which has excellent high-temperature strength and toughness as well as improved resistance to oxidation and high temperature corrosion. The steel of this invention is suitable for use in boilers, equipment employed in the nuclear industry, and equipment employed in chemical industries in situations requiring resistance to high pressures and oxidation resistance at high temperatures.

A variety of heat-resistant steels have been used in superheater tubes and reheater tubes for boilers and in the other heat-exchange tubes and heat-resistant, pressure-resistant piping in the nuclear and chemical industries. Such heat-resistant steels have excellent high-temperature strength, a marked resistance to high-temperature corrosion and oxidation, and good toughness. In addition, they must be enconomical, yet at the same time exhibit excellent formability and weldability.

Conventional steels fur such uses include (i) austenitic stainless steels, (ii) low-alloy steels such as 2¼ Cr-1Mo steel, and (iii) 9–12 Cr system high-Cr ferritic steels. High-Cr steels are superior to low-alloy steel in respect to strength and resistance to corrosion as well as oxidation, and they are free of stress corrosion cracking, which is unavoidable in austenitic stainless steel. Furthermore, high-Cr steels have a low thermal expansion coefficient and excellent thermal fatigue resistance and are still economical.

Typical examples of high-Cr steels are 9Cr-1Mo steel (ASTM T9), modified 9Cr-1Mo steel (ASTM A213 T91), and 12Cr-1Mo steel (DIN X20CrMoWV 121). Other examples having improved strength are disclosed in Japanese Patent Publication No. 36341/1982, Japanese Published Unexamined Patent Application No. 110758/1980, No. 181849/1983, and No. 89842/1987.

Heat resistant steels which contain 9–12% by weight of Cr are disclosed in Japanese Published Unexamined Patent Application No. 211553/1984, No. 110753/1986, No. 297436/1987, No. 65059/1988, and No. 76854/1988, and Japanese Patent Publication No. 8502/1987 and No. 12304/1987. These alloys contain Mo, W, V, Nb, N or the like to improve high-temperature strength.

Recently, there have been attempts to operate boilers at higher temperatures and pressures than those of conventional boilers. Thus, steel tubes for boilers which have normally been exposed at 600° C. must now be subjected to high temperature of 600°–650° C. However, conventional-high Cr steel does not have satisfactory high-temperature strength. When a conventional high-Cr steel is used in large-diameter pipes, the wall thickness has to be increased, resulting in thermal fatigue due to thermal cycling of start-up and shut-down.

On the other hand, such steels as the 9Cr-1Mo steel and 12Cr-1Mo steel have excellent high temperature strength but they do not have a satisfactory level of resistance to oxidation and corrosion at high temperatures of 600°–650° C. Thus, the highest service temperature is limited up to 625° C. for conventional 9–12Cr steels. In order to further improve the resistance to oxidation as well as corrosion at high temperatures, it is conceivable to increase the content of Cr. However, when the Cr content is increased to over 13%, for example, a large amount of δ-ferrite is formed in a matrix phase, resulting in a marked degradation in toughness and high-temperature strength. It is also possible to suppress the formation of δ-ferrite by the addition of Ni. However, the content of Ni and Cr increases, resulting in a decrease in thermal conductivity and a decrease in the thermal efficiency of the heat-exchanger. Furthermore, a high-alloy steel with a high content of Ni and Cr is quite expensive and is comparable with 18-8 austenitic stainless steels from a cost viewpoint.

Thus, steels which can be used at a high temperature of 600° C. or higher under pressure must have high-temperature strength superior to that of conventional high-Cr steels, and furthermore improved resistance to oxidation and corrosion at high temperatures compared with those of conventional high-Cr steels. They must also have toughness, formability, and weldability which are comparable to or superior to those of conventional steels.

SUMMARY OF THE INVENTION

An object of this invention is to provide high-Cr ferritic steels which are less expensive than austentic stainless steels, and which are comparable to conventional steels with respect to toughness, formability, and weldability but are much superior to 9–12Cr steels with respect to their strength at 600° C. or higher and with respect to resistance to oxidation and corrosion at 600° C. or higher.

Another object of this invention is to provide high-Cr ferritic steels which have high-temperature strength and which are comparable to 18-8 system austenitic stainless steels with respect to resistance to oxidation and high-temperature corrosion, but which are less expensive.

Still another object of this invention is to provide high-Cr ferritic steels which have superior resistance to oxidation and corrosion at a temperature of 650° C. or higher compared with conventional heat-resistant steels and which have a creep rupture strength of 8 kgf/mm$^2$ at 650° C. for $10^4$ hours.

The present inventors found that the addition of a suitable amount of solid-solution hardening elements such as W and Mo together with precipitation hardening elements such as V, Nb, N and C is effective for improving high-temperature strength of high-Cr steels. The inventors also found that the addition of Cu together with a small amount of Mg is effective for improving the resistance to oxidation and corrosion at a temperature of 600° C. or higher.

In the prior art, there have been many proposals of modifications of 9–12Cr steels to improve high-temperature strength at 600° C. or higher. However, the prior art steels do not exhibit satisfactory resistance to oxidation and high-temperature corrosion, and their service temperatures are limited up to 625° C. On the other hand, the addition of a very small amount of Cu has been thought to be effective for improving oxidation resistance, but the addition of a relatively large amount of Cu has been thought to result in a degradation in hot formability and toughness. See Japanese Published Unexamined Patent Application No. 76854/1988 and No. 65050/1988.

Experiments carried out by the present inventors showed that the Cu-containing steel disclosed in Japanese Patent Publication No. 12304/1087 has poor toughness and does not exhibit satisfactory resistance to oxidation and corrosion at a temperature of 600° C. or higher.

Furthermore, though Japanese Published Unexamined Patent Application No. 211553/1984 suggests the addition of Cu together with Mg, it does not refer to the resistance to oxidation and corrosion, and the resulting steel has poor high-temperature strength and cannot be employed under high-temperature conditions.

Thus, this invention is based on findings that the addition of Cu together with Mg results in improvements in toughness, high-temperature strength, formability, oxidation resistance, and high-temperature corrosion resistance which cannot be obtained by the addition of Cu alone. Furthermore, the high-temperature strength at 600° C. or higher is also markedly improved due to the synergistic effects of an optimized addition of Cu and Mg together with solid-solution hardening elements such as W and Mo and precipitation hardening elements such as V, Nb, N and C.

This invention is a high-temperature strength high-Cr steel with excellent toughness as well as improved resistance to oxidation and high temperature corrosion, consisting essentially of, in weight %:

C: 0.04–0.2%, Si: not greater than 0.7%,
Mn: 0.1–1.5%, Ni: greater than 1%,
Cr: 8–14%, Mo: 0.01–1.2%,
W: 0.8–3.5%, V: 0.1–0.3%,
Nb: 0.01–0.2%, Al: not greater than 0.05%,
Cu: 0.4–3%, Mg: 0.0005–0.5%, N: 0.001–0.1%
Fe and incidental impurities: balance According to another aspect, the steel of this invention may further contain 0.0001–0.02% of B.

According to still another aspect, the steel of this invention may contain at least one of La, Ce, Y, Ca, Ti, Zr, and Ta each in an amount of 0.01–0.2%.

According to a further aspect, the steel of this invention may contain 0.0001–0.02% of B and at least one of La, Ce, Y, Ca, Ti, Zr, and Ta each in an amount of 0.01–0.2%.

According to this invention, a variety of alloying elements, especially a relatively large amount of W are incorporated in suitable and balanced amounts. Furthermore, Cu, which is a less expensive alloying element but quite effective for improving oxidation resistance and high temperature corrosion, is added together with a very small amount of Mg. Therefore, the resulting steels can exhibit excellent high-temperature properties, particularly excellent high-temperature creep strength, toughness, formability and weldability.

DESCRIPTION OF THE PREFERRED EMBODIMENTS

Figure 1:
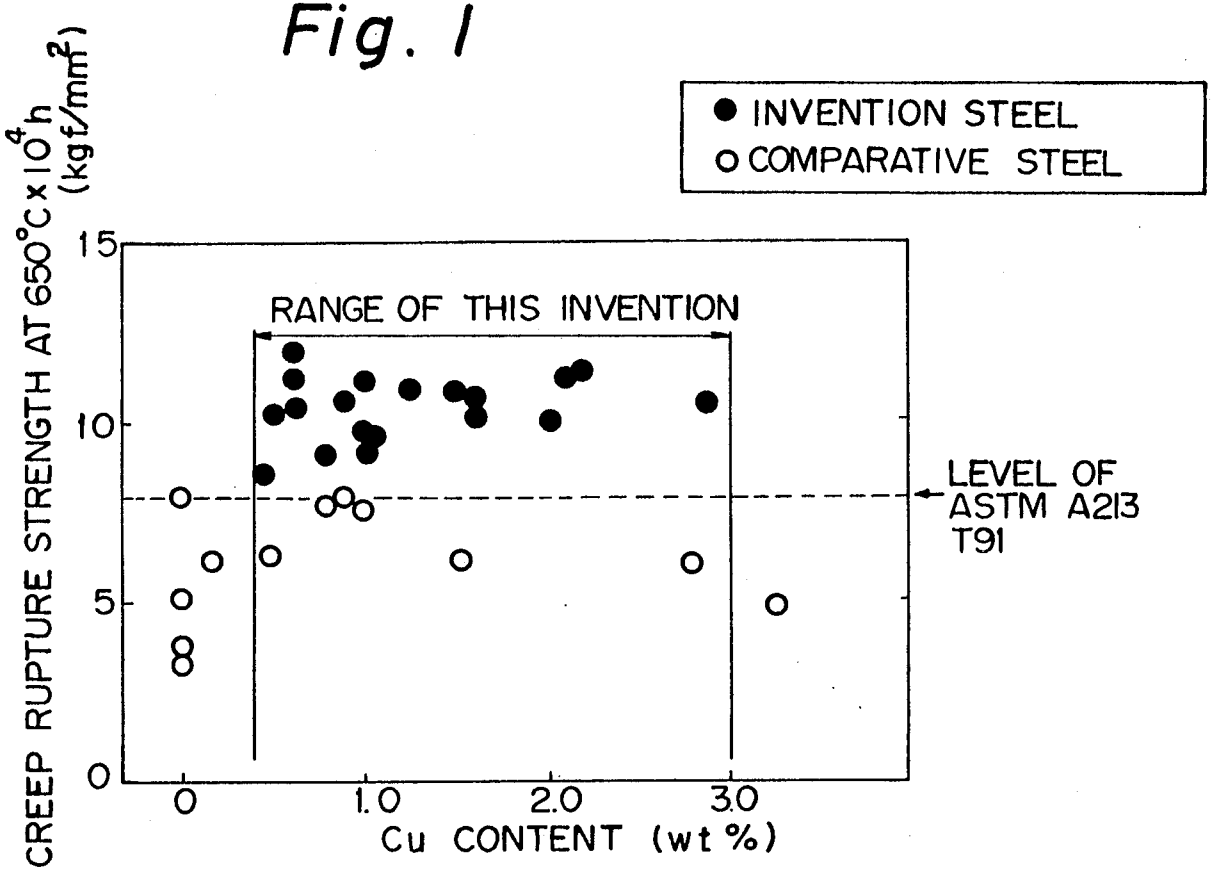
FIG. 1 is a graph showing the relationship between the creep rupture strength at 650° C. for $10^4$ hours and the Cu content for the steels of this invention and comparative steels.

The effective of the alloying elements of this invention and the reasons for the above-mentioned limits on the content of each of these elements will now be described. "%" means % by weight throughout the present specification unless otherwise indicated.

Cu and Mg:

The addition of Cu together with Mg produces a synergistic effect that is one of the important features of the steel of this invention.

As already mentioned, there have been proposals to add Cu to steel. However, since the resistance to oxidation and corrosion at 600° C. or higher has never been evaluated quantitatively, it was not clear before this invention whether the addition of a large amount of Cu is advantageous. Japanese Patent Publication NO. 12304/1987 suggests that the addition of 0.4–1.5% of Cu together with W and N would be effective for improving creep strength, but is also discloses that the addition of a large amount of Cu would result in degradation in hot workability.

On the other hand, Japanese Published Unexamined patent Application No. 65059/1988 states that the addition of Cu in an amount of 0.05–0.3% is effective for preparing a $Cr_2O_3$ film which firmly adheres to the base metal to improve the resistance thereof to oxidation and that the upper limit of Cu is 0.3%, since the addition of Cu over 0.3% impairs toughness.

The present inventors thoroughly studied the mechanism by which the addition of a large amount of Cu causes a degradation in toughness, and hot workability. As a result, it was found that the addition of a small amount of Mg can eliminate the adverse effect of the addition of Cu with a resulting improvement in oxidation resistance and high temperature strength.

Namely, due to the presence of a stable $Cr_2O_3$ film, the high-Cr steel can exhibit a substantial resistance to oxidation and corrosion at a temperature of 600° C. or higher, and the addition of Cu is effective for making such a $Cr_2O_3$ film denser and stable at high temperatures with remarkable improvements in the resistance to oxidation and high-temperature corrosion. However, when a large amount of Cu is added, the added Cu itself precipitates along the grain boundaries of the matrix phase resulting in a degradation in formability and workability. In addition, when sulfur (S) is present in steel, a low melting compound of Cu and S forms to make not only the grain boundaries of the matrix but also the $Cr_2O_3$ film unstable. This causes many disadvantages, such as a degradation in toughness, strength and workability which are caused by the addition of a relatively large amount of Cu, and a deterioration in the resistance to oxidation and corrosion.

When a very small amount of Mg is added together with Cu, Mg serves as a stabilizer for S to eliminate such disadvantages. As will be mentioned later, rare earth elements such as Y, La, and Ce are also effective for this purpose, but the addition of a very small amount of Mg is the most effective. This is because Mg is effective not only for preventing the precipitation of the low-melting point sulfide of CuS along the matrix grain boundaries and in the interface between the $Cr_2O_3$ film and the base metal, but also for further stabilizing the $Cr_2O_3$ film.

It is to be noted that Cu itself is also effective as a stabilizer for an austenite phase, and it is possible to suppress the formation of δ-ferrite. In addition, the addition of Cu does not lower the $Ac_1$ transformation temperature ($Ac_1$ point) as much as Ni does. Furthermore, when a Cu phase is precipitated in the matrix, it is thought that high-temperature creep strength will also be improved if Mg is added together with a large amount of Cu, e.g., 1% or more and preferably 1.5% or more.

The addition of less than 0.4% of Cu is, however, not enough to improve the resistance to oxidation and corrosion. But, when more than 3% of Cu is added, much Cu precipitates along the grain boundaries of the matrix phase, resulting in a degradation in toughness, high-temperature strength, formability, and workability. Therefore, it is advisable to add Cu in an amount of 0.4–3%, preferably 1–3%, and more preferably 1.5–2.5%.

Mg is an essential element which is effective for preventing segregation of S to further stabilize the $Cr_2O_3$ film and matrix grain boundaries. The degradation in workability, toughness, and high-temperature strength which are caused by the segregation of S to grain boundaries can be effectively eliminated by the addition of Mg.

The addition of Mg in an amount of less than 0.0005% is not enough for these purposes, but when Mg is added in an amount of more than 0.5%, the effectiveness thereof saturates. Preferably, Mg is added in an amount of 0.0005–0.02% and more preferably 0.001–0.01%.

C:

Carbon forms carbides with Cr, Fe, Mo, W, V, and Nb to improve high-temperature strength. In addition, since carbon is an austenite-stabilizing element, the addition of carbon suppresses the formation of δ-ferrite. However, when carbon in an amount of less than 0.04% is incorporated, a sufficient amount of carbides does not precipitate and a relatively large amount of δ-ferrite precipitates, resulting in a deterioration in strength and toughness. In contrast, when over 0.2% of carbon is added, an excess amount of carbides precipitates, resulting in overhardening of steel, and formability and workability as well as weldability are impaired. A suitable carbon content is 0.04–0.2%, and preferably 0.06–0.15%.

Cr:

Cr is one of the essential elements to the steel of this invention in order to obtain satisfactory resistance to oxidation and high-temperature corrosion. When Cr in an amount of less than 8% is added, a sufficient level of resistance to oxidation and high-temperature corrosion cannot be obtained. In contrast, when Cr in an amount of more than 14% is added, the amount of δ-ferrite increases, resulting in a degradation in strength, workability, and toughness, Preferably, the Cr content is 9–13%.

Si:

Si serves as a deoxidizer and can strengthen the resistance of the steel to steam oxidation. When more than 0.7% of Si is added, toughness is markedly deteriorated and creep strength is adversely affected. Particularly, for thick-wall pipes and plates, embrittlement will be caused during a long-term heating. It is desirable to restrict the Si content to as low a level as possible in order to suppress the embrittlement. The upper limit of the Si content is 0.7%.

Preferably, the Si content is 0.01–0.7% and more preferably 0.01–0.2%.

Mn:

Mn is effective to improve hot workability and stabilize the martensite structure of steel. However, when less than 0.1% of Mn is added, there is substantially no effect. When more than 1.5% of Mn is added, the resulting steel is hardened so much that workability as well as weldability are greatly impaired. Thus, the Mn content of the steel of this invention is restricted to 0.1–1.5%, preferably 0.1–1.1%, and more preferably 0.3–0.7%.

Ni:

Ni serves as an austenite former to stabilize the martensite structure. Ni is also effective for preventing the degradation of workability for Cu-containing steels. When more than 1% of Ni is added, the $Ac_1$ transformation temperature is lowered so much that tempering is not adequately achieved when the tempering heat treatment is carried out during or after hot working. High-temperature creep strength is also impaired. From the viewpoint of economy, addition of much Ni is undesirable. Therefore, the addition of Ni is restricted to not greater than 1%, preferably to 0.05–1%, and more preferably to 0.3–1%.

Mo:

Mo is effective not only as a solid-solution hardening element but also as a precipitation-hardening element which forms finely-dispersed carbides, so the addition of Mo improves the high-temperature creep strength of the resulting steel. In particular, a very small amount of Mo is still effective in the presence of W, although the intended effect cannot be obtained when less than 0.01% of Mo is added. In contrast, when more than 1.2% of Mo is added, the amount of δ-ferrite increases, resulting in a degradation in toughness and workability. Furthermore, when the steel is heated for long periods of time, intermetallic compounds are coarsely precipitated which embrittle the steel. Therefore, the Mo content is restricted to 0.01–1.2%, preferably 0.1–1.2%, and more preferably 0.1–0.7%.

W:

W is also effective not only as a solid-solution hardening element but also as a precipitation-hardening element which forms finely-dispersed carbides, so the addition of W improves the high-temperature creep strength much more than Mo does. However, W is more effective for improving high temperature creep strength when added together with Mo. W is remarkably effective when 0.8% or more of W is added in the presence of Mo. One of the features of this invention is that a relatively large amount of W is added. When 3.5% or more of W is added, toughness and workability are impaired. It is advisable to add more W than Mo. This is because the atomic diameter of W is larger than that of Mo and diffusion of W is shorter than that of Mo. Therefore, the ability of W to prevent precipitates from growing and coarsening is greater than that of Mo. A preferred range for W is 0.8–3%, and a more preferred range is 1.5–3%.

V:

V combines with C and N to form finely-dispersed V(C,N). In particular, when a relatively large amount of N is added, stable compounds of V(C,N) are precipitated to markedly improve the creep strength for a long-term creep, since the V(C,N) is stable for a long-term creep at high temperatures. Less than 0.1% of V is not enough to achieve adequate effectiveness. However, when more than 0.3% of V is added, the amount of soluble V increases, resulting in a degradation in strength.

Nb:

Like V, Nb combines with C and N to form finely-dispersed precipitates of Nb(C,N) which are effective for improving creep rupture strength. The Nb(C,N) is particularly effective for improving creep strength for a shorter period of creep. Less than 0.01% of Nb is not enough, but when more than 0.2% of Nb is added, an increasing amount of Nb(C,N) remains undissolved during normalizing heat treatment, resulting in a degradation in strength and weldability. The Nb(C,N) is coarsened during creep, resulting in a degradation in creep rupture strength. It is advisable to add less Nb than V, since Nb is more effective than V. A preferred Nb content is 0.03–0.1% and more preferably 0.03–0.08%.

Al:

Al is added as a deoxidizer. However, when more than 0.05% of Al is added, creep rupture strength is impaired. So, the content of Al is defined as 0.05% or less. Preferably, the content of Al is restricted to 0.0005–0.05% so as to achieve a thorough deoxidation without impairing strength. More preferably, the content of Al is 0.005–0.03%.

N:

N combines with V and Nb to form finely-dispersed carbonitrides which are effective for improving creep rupture strength. N combines mainly with V to form stable compounds of V(C,N). The addition of less than 0.001% of N is not sufficiently effective. However, when more than 0.1% of N is added, weldability and workability are degraded. Preferably, the N content is 0.02–0.1%, a more preferred N content is 0.02–0.08%, and a still more preferred N content is 0.04–0.08%.

The following optional elements can be added to further improve the properties of the steel of this invention.

B:

B is effective for finely dispersed and stabilizing precipitated carbides. Less than 0.0001% of B is not adequately effective, but when more than 0.02% of B is added, weldability and workability are impaired. Therefore, when added, the B content is restricted to 0.0001–0.02%. La, Ce, Y, Ca, Ti, Zr and Ta:

These elements are added for the purpose of precipitating impurities such as P, S, and oxygen as non-metallic inclusions in a stable and harmless form. At least one of these elements may be added in an amount of 0.01% or more each so that the above-described impurities are fixed as stable and neutral precipitates, which have no adverse effect on properties of the resulting steel. The addition of these elements improves the strength and toughness. However, when at least one of these elements is added in an amount of more than 0.2% each, the amount of non-metallic inclusions increases, resulting in a degradation in toughness, Therefore, the content of each of these optional elements is restricted to 0.001–0.2% when added.

Since the steel of this invention must contain Cu, it is very important to prepare a refined steel so as to attain a desired degree of strength, toughness, and workability. For this purpose at least one of La, Ce, Y, Ca, Ti, Zr and Ta is added. The addition of these elements is also effective to further promote effectiveness of Mg.

The balance of the steel of this invention comprises Fe and incidental impurities. These impurities include P and S. It is desirable that the content of P be 0.025% or less and that of S be 0.015% or less. The presence of these impurities in steel impairs toughness, workability, and weldability. Particularly, since the steel of this invention contains Cu, grain boundaries and the $Cr_2O_3$ film are made unstable when a very minor amount of S is present, resulting in a degradation in strength, toughness, and workability. Thus, it is preferable that the content of these impurities be restricted to as low a level as possible within the allowable upper limits described above.

After hot working, the steel of this invention is usually subjected to heat treatment. A typical heat treatment which can be employed for this purpose is a combination of normalizing and tempering. Annealing is also applicable. It is preferable that the treatment temperature for the normalizing or annealing be equal to or higher than an $Ac_3$ point of steel so as not only to significantly dissolve the coarse precipitates formed during the preceeding hot working but to homogenize the segregation of alloying elements which occurred during casting. The upper limit of the heating temperature is defined as 1200° C. so as to prevent the formation of oxide scales and to suppress the precipitation of a large amount of δ-ferrite. A preferable heating temperature range is 1000°–1150° C.

The metallurgical structure after normalizing is a martensitic structure of a single phase, or a martensitic structure containing δ-ferrite. When the amount of δ-ferrite is large, strength and toughness are degraded. However, even in a steel comprising a combined structure of martensite and δ-ferrite, when the amount of δ-ferrite is relatively small, formability can be improved to some extent. Usually, the content of δ-ferrite is adjusted to 30% by volume or less, preferably5–30% by volume.

After normalizing, tempering is performed. The tempering treatment is carried out at a temperature15-0°–200° C. higher than service temperatures in order to decrease the dislocation density in the fresh martensite structure and stabilize the high-temperature creep strength. A preferable temperature range for this purpose is 750°–830° C. For the purpose of performing high temperature tempering, a material having a higher $Ac_1$ point is preferable. When the tempering is carried out insufficiently, sometimes the creep rupture strength is sharply lowered at high temperatures and after long periods of time.

The metallurgical structure after annealing is a ferrite (α) containing carbo-nitrides. The steel after annealing is not so good as the material which has been subjected to normalizing and tempering with respect to toughness and strength. However, the material after annealing is rather soft, and is superior to the normalized and tempered one with respect to formability and creep elongation. From a practical viewpoint, it is preferable that the steel of this invention be subjected to normalizing and then tempering.

This invention will now be described in further detail by way of the following working examples.

EXAMPLES

Steels having the chemical compositions shown in Table 1 were melted using a vacuum melting furnace with a capacity of 50 kg to prepare ingots. The ingots were then forged at 1150°–950° C. to form plates, each measuring 20 mm thick.

Steel No. 1 of Table 1 was ASTM T9, Steel No. 2 was 9Cr-2Mo steel (HCM9M, tradename of Sumitomo Metals) which was also designated as STBA 27 in the Japanese Boiler Specifications of the Thermal and Nuclear Power Generation Engineering Institute, Steel No. 3 was ASTM A213 T91 (Modified 9Cr-1Mo steel), and Steel No. 4 was DIN X20CrMoWV121. All were conventional, typical high-Cr ferrite steels.

Steels Nos. 5 through 9 were comparative steels which contained Cu but not Mg.

Steels Nos. 10 through 26 were steels of this invention in which Cu was added together with Mg, and a relatively large amount of W was also added.

Steels Nos. 27 and 28 were steels of this invention which comprised 25% and 6% by volume of δ-ferrite, respectively.

Steel No. 29 was a comparative steel disclosed in Japanese Published Unexamined Patent Application No. 211553/1984 and contained Cu and Mg, but a small amount of W. Steel No. 30 was a comparative steel for use in turbine rotors disclosed in Japanese Patent Publication No. 12304/1987, and Steel No. 31 was a comparative steel comprising 33% by volume of δ-ferrite, but with W outside the range of this invention.

A conventional heat treatment comprising heating at 950° C. for 1 hour, air cooling, heating at 750° C. for 1 hour, and then air cooling was performed on Steels Nos. 1 and 2.

Since Steels Nos. 5 through 31 were all strengthened steels containing V and/or Nb, a normalizing heat treatment comprising heating at 1050° C. for 1 hour and then air cooling, and a tempering heat treatment comprising heating at 780° C. for 1 hour and then air cooling were applied to these steels.

A tensile test was carried out using test pieces measuring 6 mm (diameter)×GL 30 mm at room temperature and at 650° C. A creep test was also carried out at 650° C. for over 10,000 hours using the same test pieces as in the above.

A Charpy impact test was also carried out using 10×10×55 (mm)-2 mm- V-notched specimens at 0° C.

In order to evaluate the resistance to steam oxidation, a heating test was performed in steam at 700° C. for 1000 hours using test pieces in the form of plates (10×25×2 mm). Resistance was evaluated based on the thickness of scale.

A high-temperature corrosion test was also carried out by exposing test pieces in the form of plates (15×15×3 mm) to corrosive conditions at 700° C. for 20 hours. The corrosive conditions simulated coal-ash corrosion within a boiler and comprised a synthetic coal ash (1.5 mol $K_2SO_4$-1.5 mol $Na_2SO_4$-1 mol $Fe_2O_3$) and a corrosive gas containing 1 vol % of $So_2$, 5 vol % of $O_2$, 15 vol % of $CO_2$, and a balance of $N_2$.

The test results are shown in Table 2. The creep rupture strength at 650° C. for $10^4$ hours is plotted in FIG. 1.

As apparent from the illustrated results, the steels of this invention are superior to Steel No. 3 (ASTM A 213 T91) with respect to the creep rupture strength at 650° C. for $10^4$ hours, even though ASTM A 213 T91 has been thought to be the best among the conventional high-Cr steels. This is because the steels of this invention contain Cu and Mg together with Mo, W, V, and Nb in suitable amounts. It is notable that the creep rupture strength of Steels Nos. 29 and 30, which incorporate Cu, Mg and W, but which had a rather low W content was less than 8 kgf/mm$^2$, which was far below the target value of this invention.

Figure 2:
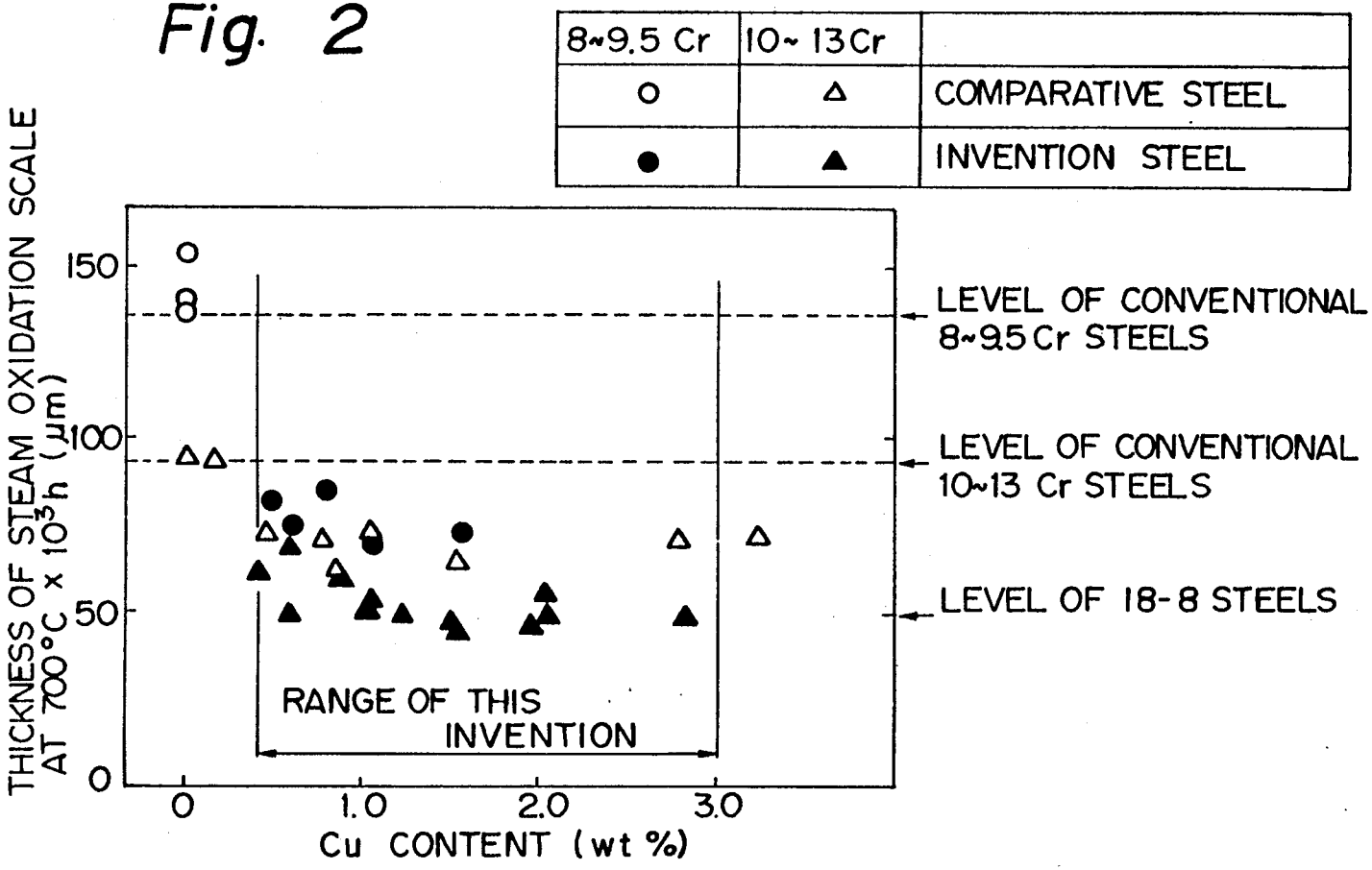
FIG. 2 is a graph showing the relationship between the thickness of scale formed by steam oxidation at 700° C. for $10^3$ hours and the Cu content for the steels of this invention and comparative steels.

FIG. 2 graphically shows the resistance to steam oxidation, i.e., oxidation resistance. In general, corrosion resistance largely depend on the Cr content of steel, and the steels listed are classified into two groups: 8–9.5% Cr steels and 10–13%Cr steels.

FIG. 2 shows that the properties of the steels of this invention are much superior to those of the conventional steels. Even the 8–9.5%Cr system steels of this invention are superior to the conventional steel containing 12% or more of Cr with respect to the oxidation resistance. Particularly, the oxidation resistance of the 10–12%Cr steels of this invention is comparable to that of 18-8 system austenitic stainless steel. The steels in which Cu was added but not Mg exhibited some improvement but were not comparable in oxidation resistance to the steel of this invention.

Figure 3:
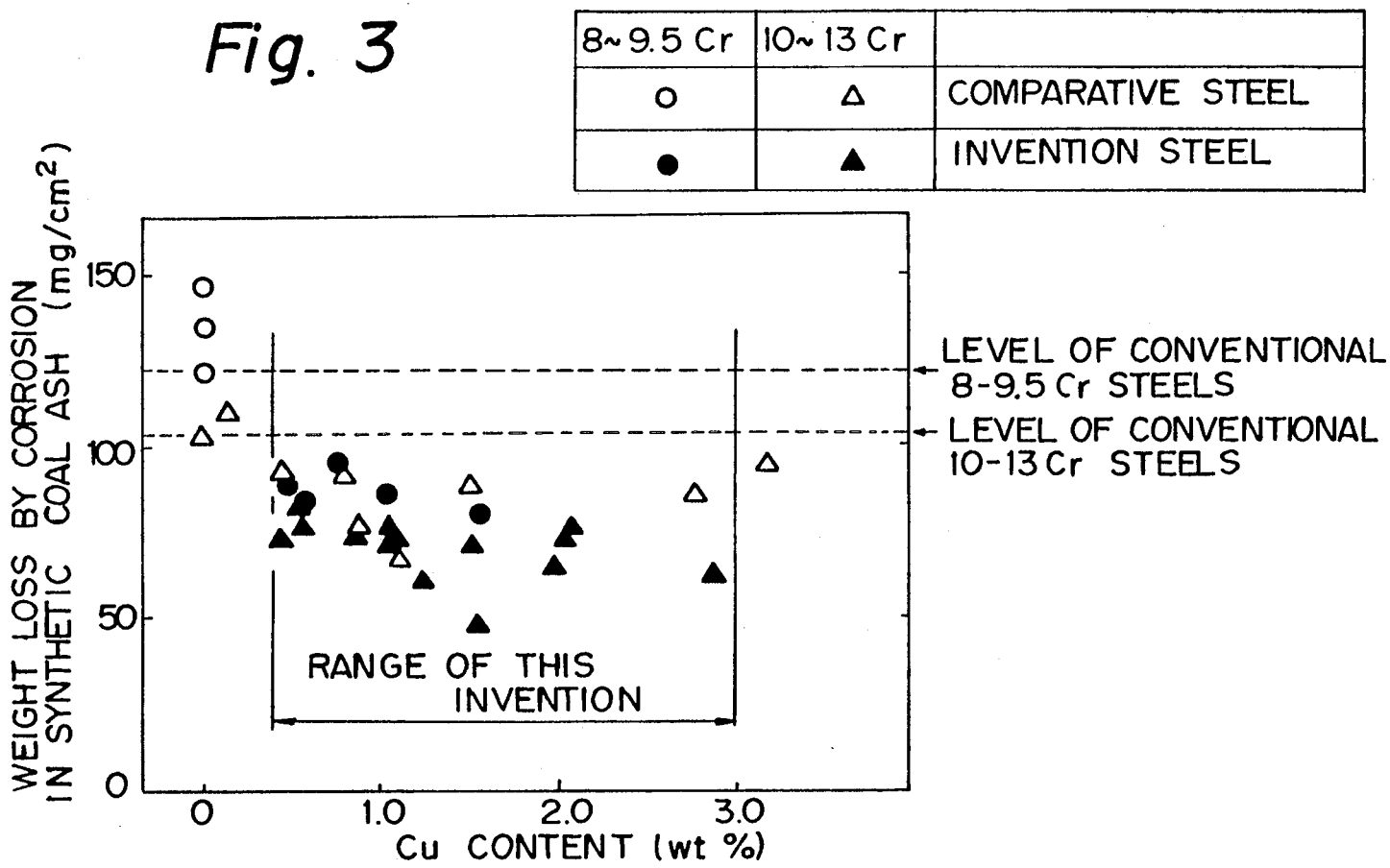
FIG. 3 is a graph showing the relationship between the corrosion weight loss and the Cu content when the steels of this invention and comparative steel were embedded in a synthetic coal ash at 700° C. for 20 hours.

Results of the high-temperature corrosion test carried out using the synthetic coal ash are graphically shown in FIG. 3. It is noted from FIG. 3 that steels containing CU are superior to steels which contain the same level of Cr but not Cu. With respect to the high-temperature corrosion, too, the addition of Cu together with Mg is much more advantageous than a sole addition of Cu.

Figure 4:
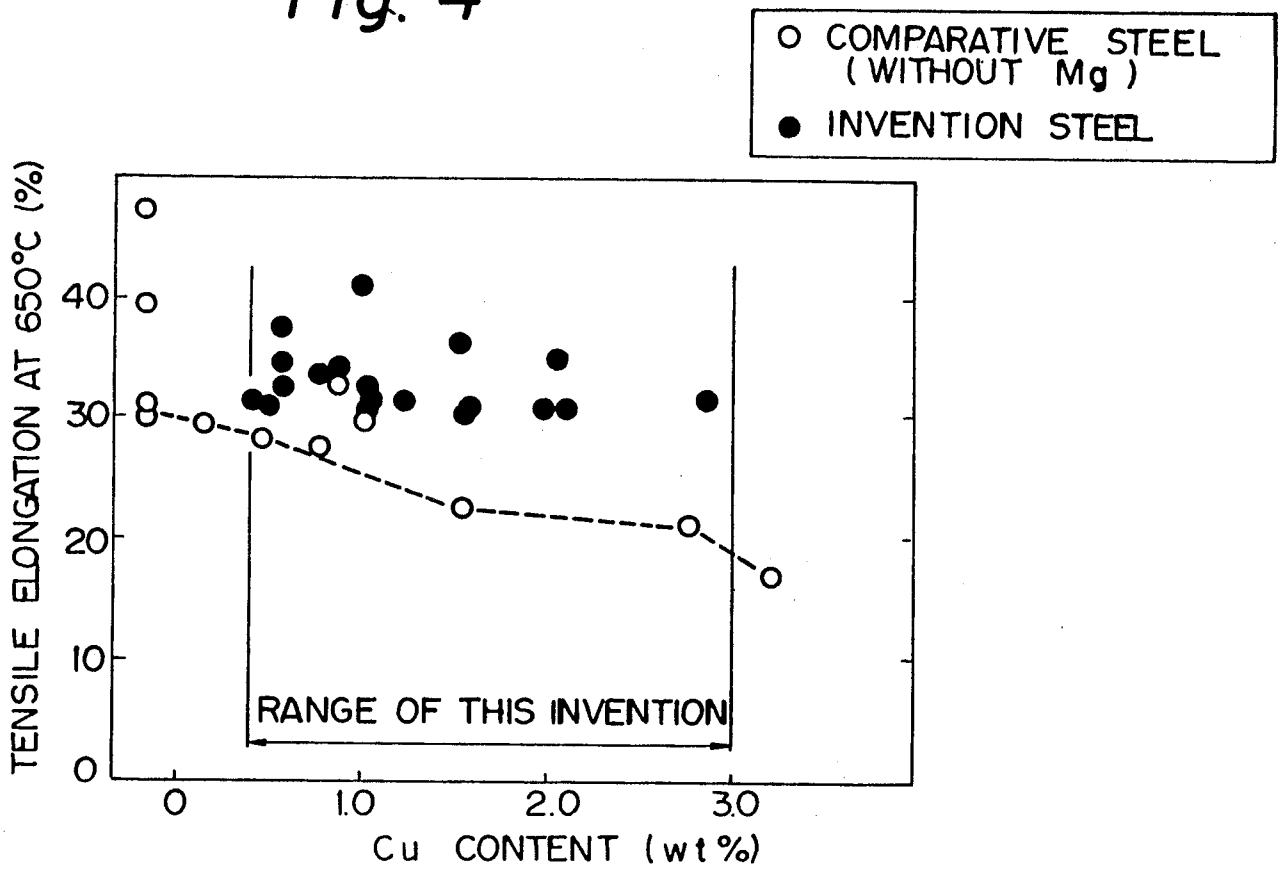
FIG. 4 is a graph showing the relationship between the tensile elongation at 600° C. and the Cu content for the steels of this invention and comparative steels.

FIG. 4 graphically shows the results of a tensile test at 650° C. It is apparent from FIG. 4 that the comparative steels containing Cu but not Mg exhibited smaller elongation. The elongation of the steels of this invention containing Mg together with Cu was substantially the same as that of conventional steels.

Figure 5:
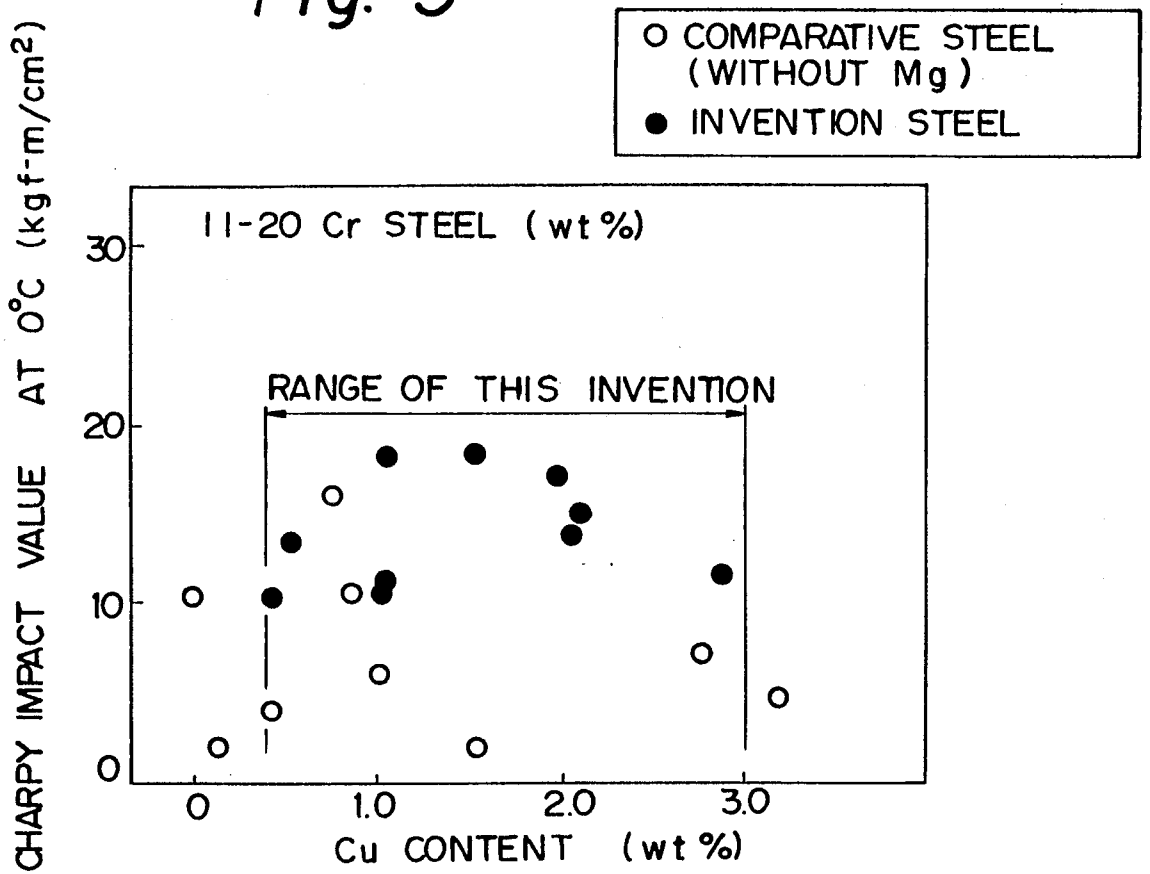
FIG. 5 is a graph showing the relationship between the Charpy impact value at 0° C. and the Cu content for the steels of this invention and comparative steels.

FIG. 5 shows the relationship between the Charpy impact value at0° C. and the Cu content for 11–12%Cr system steels. It has been thought that the addition of Cu would result in a reduction in toughness. However, according to this invention there is no reduction in toughness, since Mg is added together with Cu. However, Comparative Steel No. 31, in which Cu, Mg, and W were incorporated, but the content of W was larger than that required by this invention, exhibited a large amount of δ-ferrite and poor toughness.

Thus, in conclusion, all the steels of this invention can exhibit excellent creep rupture strength compact with that of conventional high-Cr steels. The resistance to oxidation and to high-temperature corrosion is also improved markedly in accordance with this invention. Furthermore, the toughness and ductility of the steels of this invention are comparable to those of conventional steels containing substantially the same level of Cr.

The steel of this invention can be successfully used as forged structural members for boilers, heat exchangers, and the like in the chemical and nuclear power industries in the form of pipes, plates, and the like, which are exposed to high-temperature and high-pressure environments during service at 600° C. or higher.

TABLE 1

| | No. | C | Si | Mn | P | S | Ni | Cr | Mo | W | V |
|---|---|---|---|---|---|---|---|---|---|---|---|
| Comparative | 1 | 0.13 | 0.59 | 0.37 | 0.021 | 0.005 | 0.13 | 8.78 | 1.01 | — | — |
| | 2 | 0.08 | 0.27 | 0.53 | 0.015 | 0.004 | 0.12 | 9.31 | 2.13 | — | — |
| | 3 | 0.11 | 0.42 | 0.39 | 0.014 | 0.003 | 0.08 | 8.42 | 0.95 | — | 0.21 |
| | 4 | 0.22 | 0.52 | 0.43 | 0.011 | 0.006 | 0.15 | 12.12 | 1.03 | 0.57 | 0.35 |
| | 5 | 0.10 | 0.15 | 0.62 | 0.014 | 0.007 | 0.13 | 11.03 | 1.05 | 0.47 | 0.25 |
| | 6 | 0.09 | 0.43 | 0.52 | 0.013 | 0.010 | 0.25 | 11.01 | 1.07 | 0.52 | 0.23 |

TABLE 1-continued

| | | | | | | | | | | | |
|---|---|---|---|---|---|---|---|---|---|---|---|
| | 7 | 0.12 | 0.05 | 0.47 | 0.005 | 0.003 | 0.17 | 10.95 | 0.98 | 0.51 | 0.22 |
| | 8 | 0.11 | 0.30 | 0.39 | 0.014 | 0.008 | 0.08 | 10.87 | 0.97 | 0.49 | 0.24 |
| | 9 | 0.11 | 0.05 | 0.61 | 0.011 | 0.003 | 0.08 | 10.57 | 1.01 | 0.85 | 0.21 |
| This | 10 | 0.10 | 0.12 | 0.57 | 0.008 | 0.001 | 0.17 | 11.21 | 1.05 | 0.92 | 0.25 |
| Invention | 11 | 0.10 | 0.21 | 0.53 | 0.015 | 0.005 | 0.52 | 11.03 | 1.18 | 1.03 | 0.28 |
| | 12 | 0.11 | 0.03 | 0.48 | 0.009 | 0.004 | 0.37 | 10.99 | 1.10 | 1.21 | 0.15 |
| | 13 | 0.09 | 0.10 | 0.73 | 0.010 | 0.003 | 0.75 | 11.82 | 1.10 | 1.21 | 0.25 |
| | 14 | 0.05 | 0.03 | 1.42 | 0.015 | 0.002 | 0.87 | 8.42 | 0.15 | 3.42 | 0.21 |
| | 15 | 0.17 | 0.27 | 1.02 | 0.009 | 0.005 | 0.42 | 13.75 | 0.32 | 1.87 | 0.22 |
| | 16 | 0.10 | 0.10 | 0.37 | 0.012 | 0.003 | 0.32 | 9.52 | 0.21 | 1.95 | 0.18 |
| | 17 | 0.08 | 0.07 | 0.32 | 0.015 | 0.005 | 0.14 | 9.08 | 0.25 | 2.21 | 0.25 |
| | 18 | 0.09 | 0.08 | 0.52 | 0.014 | 0.003 | 0.17 | 9.05 | 0.15 | 2.52 | 0.21 |
| | 19 | 0.12 | 0.07 | 0.10 | 0.009 | 0.002 | 0.15 | 9.21 | 0.11 | 2.22 | 0.17 |
| | 20 | 0.13 | 0.05 | 0.87 | 0.015 | 0.001 | 0.21 | 11.05 | 0.21 | 1.85 | 0.25 |
| | 21 | 0.12 | 0.03 | 0.95 | 0.011 | 0.003 | 0.41 | 11.57 | 0.15 | 2.42 | 0.22 |
| | 22 | 0.11 | 0.05 | 0.37 | 0.007 | 0.004 | 0.37 | 12.03 | 0.32 | 2.03 | 0.25 |
| | 23 | 0.08 | 0.15 | 0.55 | 0.015 | 0.003 | 0.74 | 11.73 | 0.20 | 1.78 | 0.22 |
| | 24 | 0.05 | 0.22 | 0.47 | 0.012 | 0.005 | 0.74 | 11.55 | 0.62 | 1.80 | 0.21 |
| | 25 | 0.07 | 0.07 | 0.67 | 0.017 | 0.001 | 0.35 | 11.74 | 0.60 | 2.45 | 0.25 |
| | 26 | 0.09 | 0.06 | 0.85 | 0.015 | 0.007 | 0.21 | 10.98 | 0.33 | 2.37 | 0.22 |
| | 27 | 0.06 | 0.05 | 0.56 | 0.014 | 0.001 | 0.98 | 11.10 | 0.52 | 2.47 | 0.25 |
| | 28 | 0.12 | 0.06 | 0.62 | 0.013 | 0.002 | 0.87 | 11.87 | 0.30 | 2.41 | 0.23 |
| Comparative | 29 | 0.07 | 0.06 | 0.55 | 0.015 | 0.002 | 0.90 | 12.00 | 2.30 | — | 0.18 |
| | 30 | 0.18 | 0.22 | 0.51 | 0.007 | 0.004 | 0.86 | 10.89 | 0.88 | 0.28 | 0.21 |
| | 31 | 0.08 | 0.18 | 0.45 | 0.017 | 0.003 | 0.15 | 12.21 | 0.11 | 3.82 | 0.20 |

| | No. | Nb | Al | Cu | Mg | N | B | Fe | Others |
|---|---|---|---|---|---|---|---|---|---|
| Comparative | 1 | — | 0.003 | 0.01 | — | 0.026 | — | Bal. | (ASTM-T9) |
| | 2 | — | 0.011 | 0.01 | — | 0.014 | — | " | (STBA27) |
| | 3 | 0.07 | 0.012 | 0.01 | — | 0.051 | — | " | (ASTM.A213.T91) |
| | 4 | — | 0.021 | 0.01 | — | 0.041 | — | " | (DIN.X20CrMoWV) |
| | 5 | 0.09 | 0.015 | 0.15 | — | 0.021 | — | " | |
| | 6 | 0.08 | 0.014 | 0.45 | — | 0.037 | — | " | |
| | 7 | 0.08 | 0.008 | 1.51 | — | 0.015 | — | " | |
| | 8 | 0.09 | 0.015 | 2.75 | — | 0.024 | — | " | |
| | 9 | 0.05 | 0.012 | 3.21 | — | 0.021 | — | " | |
| This | 10 | 0.03 | 0.013 | 0.42 | 0.005 | 0.022 | — | " | |
| Invention | 11 | 0.09 | 0.008 | 1.03 | 0.010 | 0.015 | — | " | |
| | 12 | 0.15 | 0.025 | 1.97 | 0.002 | 0.038 | — | " | |
| | 13 | 0.05 | 0.023 | 2.85 | 0.015 | 0.042 | — | " | |
| | 14 | 0.08 | 0.015 | 1.54 | 0.007 | 0.057 | 0.005 | " | |
| | 15 | 0.05 | 0.011 | 1.55 | 0.003 | 0.049 | 0.008 | " | |
| | 16 | 0.07 | 0.009 | 1.03 | 0.001 | 0.015 | — | " | La = 0.12, Ce = 0.05 |
| | 17 | 0.03 | 0.015 | 0.57 | 0.002 | 0.047 | — | " | Ti = 0.11 |
| | 18 | 0.08 | 0.009 | 0.47 | 0.011 | 0.052 | — | " | Ca = 0.15 |
| | 19 | 0.05 | 0.011 | 0.75 | 0.003 | 0.009 | — | " | Ta = 0.12 |
| | 20 | 0.07 | 0.011 | 0.85 | 0.001 | 0.045 | 0.005 | " | Y = 0.12 |
| | 21 | 0.08 | 0.009 | 1.23 | 0.002 | 0.051 | 0.011 | " | Zr = 0.05 |
| | 22 | 0.05 | 0.011 | 0.56 | 0.008 | 0.062 | — | " | Y = 0.15, Ca = 0.05 |
| | 23 | 0.07 | 0.015 | 2.03 | 0.003 | 0.070 | — | " | Y = 0.12, Zr = 0.04 |
| | 24 | 0.05 | 0.011 | 1.54 | 0.004 | 0.065 | — | " | La = 0.10, Ti = 0.05 |
| | 25 | 0.08 | 0.007 | 2.07 | 0.005 | 0.045 | — | " | Ce = 0.05, Ti = 0.05 |
| | 26 | 0.05 | 0.017 | 0.57 | 0.010 | 0.057 | 0.003 | " | Ta = 0.15, Y = 0.05 |
| | 27 | 0.08 | 0.030 | 1.02 | 0.005 | 0.075 | — | " | δ-ferrite = 25% |
| | 28 | 0.07 | 0.027 | 1.01 | 0.001 | 0.062 | — | " | δ-ferrite = 6% |
| Comparative | 29 | 0.07 | 0.004 | 0.85 | 0.005 | 0.055 | — | " | |
| | 30 | 0.10 | — | 0.78 | — | 0.060 | — | " | |
| | 31 | 0.05 | 0.004 | 1.02 | 0.003 | 0.041 | — | " | δ-ferrite = 33% |

TABLE 2

| | | Tensile Test at Room Temp. | | | Tensile Test at 650° C. | | |
|---|---|---|---|---|---|---|---|
| | No. | Tensile Strength (kgf/mm²) | 0.2% Offset Yield Strength (kgf/mm²) | Elongation (%) | Tensile Strength (kgf/mm²) | 0.2% Offset Yield Strength (kgf/mm²) | Elongation (%) |
| Comparative | 1 | 78.2 | 57.8 | 23.1 | 27.8 | 21.8 | 47.3 |
| | 2 | 65.4 | 51.3 | 24.5 | 25.2 | 16.1 | 39.8 |
| | 3 | 67.5 | 49.7 | 24.3 | 30.5 | 20.0 | 30.2 |
| | 4 | 76.8 | 54.7 | 25.1 | 28.4 | 20.3 | 31.1 |
| | 5 | 72.5 | 49.7 | 21.3 | 30.4 | 21.5 | 29.7 |
| | 6 | 69.3 | 50.2 | 17.5 | 31.3 | 20.3 | 28.5 |
| | 7 | 71.1 | 50.9 | 16.2 | 30.8 | 21.7 | 22.7 |
| | 8 | 71.5 | 52.3 | 12.1 | 33.5 | 22.3 | 21.3 |
| | 9 | 74.2 | 53.8 | 15.4 | 32.7 | 19.8 | 17.2 |
| This | 10 | 71.7 | 48.7 | 22.1 | 31.5 | 20.7 | 31.5 |
| Invention | 11 | 69.8 | 50.1 | 21.5 | 30.7 | 21.5 | 32.7 |
| | 12 | 72.4 | 51.3 | 23.7 | 32.4 | 22.4 | 30.8 |
| | 13 | 71.5 | 52.7 | 21.5 | 31.7 | 21.3 | 31.5 |
| | 14 | 72.3 | 54.6 | 20.8 | 32.1 | 21.1 | 30.5 |
| | 15 | 74.3 | 56.2 | 21.3 | 33.7 | 22.5 | 31.4 |
| | 16 | 69.7 | 50.3 | 23.4 | 30.7 | 20.8 | 30.4 |

TABLE 2-continued

| | | | | | | | |
|---|---|---|---|---|---|---|---|
| | 17 | 70.4 | 52.4 | 25.1 | 31.3 | 21.3 | 32.5 |
| | 18 | 71.5 | 51.7 | 24.2 | 33.0 | 22.6 | 31.1 |
| | 19 | 68.7 | 48.9 | 21.5 | 31.5 | 21.5 | 33.7 |
| | 20 | 70.3 | 50.4 | 24.3 | 30.4 | 20.8 | 34.2 |
| | 21 | 69.7 | 49.8 | 22.5 | 31.2 | 22.5 | 31.5 |
| | 22 | 70.8 | 53.7 | 21.4 | 33.6 | 24.3 | 37.6 |
| | 23 | 73.4 | 52.2 | 23.5 | 31.7 | 24.5 | 35.4 |
| | 24 | 71.5 | 50.6 | 22.1 | 30.6 | 22.6 | 36.7 |
| | 25 | 68.7 | 49.7 | 24.1 | 31.5 | 23.4 | 31.1 |
| | 26 | 70.6 | 51.6 | 22.7 | 32.6 | 20.9 | 30.7 |
| | 27 | 69.5 | 48.7 | 32.1 | 30.8 | 21.5 | 40.3 |
| | 28 | 74.3 | 54.1 | 22.7 | 33.4 | 23.7 | 30.6 |
| Comparative | 29 | 66.1 | 48.5 | 30.7 | 28.6 | 20.1 | 33.3 |
| | 30 | 77.2 | 56.8 | 20.7 | 28.3 | 22.1 | 27.5 |
| | 31 | 74.3 | 55.4 | 17.8 | 31.5 | 22.4 | 30.5 |

| | No. | Charpy Impact Value at 0° C. (kgf-m/cm$^2$) | Creep Rupture Strength at 650 °C. × $10^4$ h. (kgf/mm$^2$) | Scale Thickness of Steam-Oxidation Test at 700° C. × $10^3$ h. (μm) | Weight Loss by Corrosion in Synthetic Coal Ash at 700° C. × 20 h. (mg/cm$^2$) |
|---|---|---|---|---|---|
| Comparative | 1 | 10.3 | 3.2 | 154 | 135 |
| | 2 | 17.8 | 3.8 | 140 | 147 |
| | 3 | 31.1 | 8.0 | 137 | 122 |
| | 4 | 10.7 | 5.2 | 72 | 103 |
| | 5 | 2.1 | 6.1 | 81 | 111 |
| | 6 | 3.7 | 6.4 | 73 | 94 |
| | 7 | 2.0 | 6.2 | 65 | 89 |
| | 8 | 7.4 | 6.1 | 71 | 85 |
| | 9 | 4.8 | 4.8 | 70 | 92 |
| This Invention | 10 | 10.4 | 8.7 | 63 | 80 |
| | 11 | 11.3 | 9.2 | 55 | 74 |
| | 12 | 17.3 | 10.1 | 48 | 65 |
| | 13 | 11.5 | 10.5 | 50 | 62 |
| | 14 | 10.7 | 10.2 | 73 | 82 |
| | 15 | 10.8 | 10.8 | 45 | 48 |
| | 16 | 27.3 | 9.8 | 70 | 88 |
| | 17 | 30.4 | 11.3 | 75 | 85 |
| | 18 | 26.8 | 10.3 | 82 | 90 |
| | 19 | 31.5 | 9.2 | 85 | 97 |
| | 20 | 13.7 | 10.7 | 58 | 75 |
| | 21 | 12.4 | 11.0 | 50 | 62 |
| | 22 | 10.8 | 10.5 | 50 | 78 |
| | 23 | 13.7 | 11.3 | 57 | 71 |
| | 24 | 18.5 | 10.8 | 48 | 70 |
| | 25 | 15.4 | 11.4 | 50 | 75 |
| | 26 | 11.8 | 12.0 | 70 | 85 |
| | 27 | 10.5 | 9.8 | 48 | 75 |
| | 28 | 18.5 | 11.2 | 49 | 70 |
| Comparative | 29 | 10.2 | 8.0 | 61 | 75 |
| | 30 | 15.7 | 7.9 | 68 | 90 |
| | 31 | 6.0 | 7.7 | 71 | 66 |

What is claimed is:

1. A high-strength high-Cr steel with excellent high-temperature strength and toughness as well as improved resistance to oxidation and high-temperature corrosion, which consists essentially of, in weight %:

C: 0.004–0.2%, Si: not greater than 0.7%,
Mn: 0.1–1.5%, Ni: not greater than 1%,
Cr:8–14%, Mo: 0.01–1.2%,
W: 0.8–3.5%, V: 0.1–0.3%,
Nb: 0.01–0.2%, Al: not greater than 0.05%,
Cu: 0.4–3%, Mg: 0.0005–0.5%,
N: 0.001–0.1%
B: 0–0.02%,
at least one of La, Ce, Y, Ca, Ti, Zr, and Ta are each in an amount of 0–0.2%, and
Fe and incidental impurities: balance.

2. A high-strength high-Cr steel as set forth in claim 1 wherein the content of B is 0.0001–0.2%.

3. A high-strength high-Cr steel as set forth in claim 1 containing at least one of La, Ce, Y, Ca, Ti, Zr, and Ta each in an amount of 0.01–0.2%.

4. A high-strength high-Cr steel as set forth in claim 1 containing 0.0001–0.02% of B and at least one of La, Ce, Y, Ca, Ti, Zr, and Ta each in an amount of 0.01–0.2%.

5., A high-strength high-Cr steel as set forth in claim 1 wherein:

Si: 0.01–0.7%, Ni: 0.05–1%,
Al: 0.005–0.05%, and N: 0.02–0.1%.

6. A high-strength high-Cr steel as set forth in claim 1 wherein

Si: 0.01–0.04%, Mn: 0.1–1.1%,
Ni: 0.05–1%, Mo: 0.1–1.2%,
W: 0.08–3%, Al: 0.005–0.05%,
Cu: 1–3%, Mg: 0.005–0.02%, and
N: 0.02–0.08%.

7. A high-strength high-Cr steel as set forth in claim 1 wherein

C: 0.06–0.15%, Si: 0.01–0.2%,
Mn: 0.3–0.7%, Ni: 0.3–1%,
Cr: 9–13%, Mo: 0.1–0.7%,
W: 1.5–3%, V: 0.2–0.3%,
Nb: 0.03–0.1%, Al: 0.005–0.03%,
Cu: 1.5–2.5%, Mg: 0.001–0.01%, and
N: 0.04–0.08%.

8. A high-strength high-Cr steel as set forth in claim 1 wherein the content of δ-ferrite is 5-30% by volume.

9. A high-strength high-Cr steel as set forth in claim 1 wherein the content of P is no greater than 0.025%.

10. A high-strength high-Cr steel as set forth in claim 1 wherein the content of P is no greater than 0.015%.

11. A high-strength high-Cr steel with excellent high-temperature strength and toughness as well as improved resistance to oxidation and high-temperature corrosion, which consists essentially of, in weight %:

C: 0.04-0.2%, Si: not greater than 0.7%,
Mn: 0.1-1.5%, Ni: not greater than 1%,
Cr: 8-14%, Mo: 0.01-1.2%,
W: 0.8-3.5%, V: 0.1-0.3%,
Nb: 0.01-0.2%, Al: not greater than 0.05%,
Cu: 0.4-3%, Mg: 0.0005-0.5%,
N: 0.001-0.1%
B: 0.001-0.02%,
at least one of La, Ce, Y, Ca, Ti, Zr, and Ta each in an amount of 0-0.02%, and
Fe and incidental impurities: balance.

12. A high-strength high-Cr steel as set forth in claim 11 containing at least one of La, Ce, Y, Ca, Ti, Zr, and Ta each in an amount of 0.01-0.2%.

13. A high-strength high-Cr steel as set forth in claim 11 wherein
Si: 0.01-0.7%, Ni: 0.05-1%,
Al: 0.005-0.05%, and N: 0.02-0.1%.

14. A high-strength high-Cr steel as set forth in claim 11 wherein
Si: 0.01-0.4%, Mn: 0.1-1.1%,
Ni: 0.05-1%, Mo: 0.1-1.2%.
W: 0.8-3%, Al: 0.005-0.05%,
Cu: 1.0-3%, Mg: 0.0005-0.02%, and
N: 0.02-0.08%.

15. A high-strength high-Cr steel as set forth in claim 11 wherein
C: 0.06-0.15%, Si: 0.01-0.2%,
Mn: 0.3-0.7%, Ni: 0.3-1%,
Cr: 9-13%, Mo: 0.1-0.7%,
W: 1.5-3%, V: 0.2-0.3%,
Nb: 0.03-0.1%, Al: 0.005-0.03%,
Cu: 1.5-2.5%, Mg: 0.001-0.01%, and
N: 0.04-0.08%.

16. A high-strength high-Cr steel as set forth in claim 11 wherein the content of δ-ferrite is 5-30% by volume.

17. A high-strength high-Cr steel as set forth in claim 11 wherein the content of P is no greater than 0.025%.

18. A high-strength high-Cr steel as set forth in claim 11 wherein the content of P is no greater than 0.015%.

19. A high-strength high-Cr steel with high-temperature strength and excellent toughness as well as improved resistance to oxidation and high-temperature corrosion, which consists essentially of, in weight %:

C: 0.04-0.2%, Si: not greater than 0.7%,
Mn: 0.1-1.5%, Ni: not greater than 1%,
Cr: 8-14%, Mo: 0.01-1.2%,
W: 0.8-3.5%, V: 0.1-0.3%,
Nb: 0.01-0.2%, Al: not greater than 0.05%,
Cu: 0.4-3%, Mg: 0.0005-0.5%,
N: 0.001-0.1%
B: 0.001-0.02%,
at least one of La, Ce, Y, Ca, Ti, Zr, and Ta each in an amount of 0.01-0.2%, and
Fe and incidental impurities: balance.

20. A high-strength high-Cr steel as set forth in claim 19 wherein
Si: 0.01-0.7%, Ni: 0.05-1%,
Al: 0.005-0.05%, and N: 0.02-0.1%.

21. A high-strength high-Cr steel as set forth in claim 19 wherein
Si: 0.01-0.4%, Mn: 0.1-1.1%,
Ni: 0.05-1%, Mo: 0.1-1.2%,
W: 0.8-3%, Al: 0.005-0.05%,
Cu: 1-3%, Mg: 0.0005-0.02%, and
N: 0.02-0.08%.

22. A high-strength high-Cr steel as set forth in claim 19 wherein
C: 0.06-0.15%, Si: 0.01-0.2%,
Mn: 0.3-0.7%, Ni: 0.3-1%,
Cr: 9-13%, Mo: 0.1-0.7%,
W: 1.5-3%, V: 0.2-0.3%,
Nb: 0.03-0.1%, Al: 0.005-0.03%,
Cu: 1.5-2.5%, Mg: 0.001-0.01%, and
N: 0.04-0.08%.

23. A high-strength high-Cr steel as set forth in claim 19 wherein the content of δ-ferrite is 5-30% by volume.

24. A high-strength high-Cr steel as set forth in claim 19 wherein the content of P is no greater than 0.025%.

25. A high-strength high-Cr steel as set forth in claim 19 wherein the content of P is no greater than 0.015%.

* * * * *